US007231990B2

(12) United States Patent
Lai

(10) Patent No.: US 7,231,990 B2
(45) Date of Patent: Jun. 19, 2007

(54) LIMIT STRUCTURE FOR A HOOK OF A PNEUMATIC TOOL

(75) Inventor: Chun-Chi Lai, Taichung (TW)

(73) Assignee: Basso Industry Corp., Taichung (TW)

( * ) Notice: Subject to any disclaimer, the term of this patent is extended or adjusted under 35 U.S.C. 154(b) by 18 days.

(21) Appl. No.: 11/129,075

(22) Filed: May 16, 2005

(65) Prior Publication Data

US 2006/0254787 A1 Nov. 16, 2006

(51) Int. Cl.
*B25C 1/04* (2006.01)

(52) U.S. Cl. ..... 173/170; 173/171; 227/156; 224/269; 248/301; 248/309.1

(58) Field of Classification Search ..... 173/168, 173/169, 170, 171; 227/130, 156; 30/298.4; 224/268, 269, 584, 930; 16/436, 426, 110.1
See application file for complete search history.

(56) References Cited

U.S. PATENT DOCUMENTS 3,076,627 A * 2/1963 Huron ..... 248/309.1
3,780,950 A * 12/1973 Brennan ..... 239/306
4,787,145 A * 11/1988 Klicker et al. ..... 30/275.4
5,180,019 A * 1/1993 Thiry et al. ..... 173/168
5,676,285 A * 10/1997 Vinarsky ..... 224/148.1
6,010,103 A * 1/2000 Ashworth ..... 248/301
6,230,367 B1 * 5/2001 Riedl ..... 16/436
6,352,235 B2 * 3/2002 Cizek ..... 248/692
6,565,743 B1 * 5/2003 Poirier et al. ..... 210/85
6,641,011 B1 * 11/2003 Kahn ..... 224/269
6,679,406 B2 * 1/2004 Sakai et al. ..... 224/269
6,722,549 B2 * 4/2004 Shkolnikov et al. ..... 227/10

* cited by examiner

*Primary Examiner*—Scott A. Smith
(74) *Attorney, Agent, or Firm*—Egbert Law Offices

(57) ABSTRACT

The limit structure for the hook of the pneumatic tool, and the area that is preset on the pneumatic tool has a cylinder hook assembly part that can be covered by a loop cover of the hook. A ring groove is placed on the circumferential area of the hook assembly part, and radial through holes are located at two radial spaced locations on the loop cover, so the center line of the through hole can pin through the ring groove. The through fixer goes through the radial through hole and through the corresponding ring groove, and the hook reaches the combination of limit state that is rotatable by locking the middle of these two through fixers in the ring groove. With this structure, it helps the limit structure for the hook of the pneumatic tool to achieve practical effects of simpler production and more convenient assembling.

5 Claims, 9 Drawing Sheets

LIMIT STRUCTURE FOR A HOOK OF A PNEUMATIC TOOL

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a pneumatic tool, and more particularly to its hook with a limit structure.

BACKGROUND OF THE INVENTION

In response to users' demand, the current pneumatic tool (such as pneumatic handle, pneumatic gun) is added with hook in convenience of hanging the pneumatic tool. However, under some circumstances, the hook is not needed, therefore, there are many hooks for pneumatic tools are designed with assembled or disassembled options.

The structure that present invention desires to improve is the limit structure of the hook mentioned above. The conventional design puts a stepped cylinder at the area that is prepared for the hook of the pneumatic tool, so that a loop cover of the hook may be placed pivotally over the cylinder. A screw clamping ring is made to be screwed onto the end of the cylinder of the pneumatic tool, and by blocking one side of the loop cover to achieve the purpose of limiting the hook. Except, this conventional structure still has the following issues in practical application.

1. From a manufacturing point of view, because the screw clamping ring and the cylinder part of the pneumatic tool has the spiral part that can be time consuming during the manufacturing process, which creates the disadvantages, such as higher cost of manufacturing, and it does not meet the preferred industrial practicality.

2. From an assembling point of view, the assembling of the screw clamping ring must be screwed on to achieve the desired position; therefore, the process is slower and less effective.

Thus, to overcome the aforementioned problems of the prior art, it would be an advancement if the art to provide an improved structure that can significantly improve the efficacy.

To this end, the inventor has provided the present invention of practicability after deliberate design and evaluation based on years of experience in the production, development and design of related products.

BRIEF SUMMARY OF THE INVENTION

1. The main objective of the limit structure of the hook of the pneumatic tool disclosed in the present invention is to achieve the pinned position by the unique design of pinning the through fixers to the ring groove and radial through hole that is placed correspondingly to the loop cover and hook assembly part of the pneumatic tool. And by this design, the purpose can be achieved by the simple structure of hole, pin and ring groove, and the manufacturing process is simpler and faster, which meets the preferred industrial practicability of simplifying the production and reducing the cost.

2. Another objective of the present invention is to improve the disadvantage of the screwing method by the new design of pinning method of the through fixer, which greatly improves the efficacy of the assembly.

3. Another objective of the present invention is to make the second end of the through fixer ring groove like for an elastic ring cover to connect to, so that the through fixer has the advantage of fast disassembly in convenience of disassembling the hook in the future.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
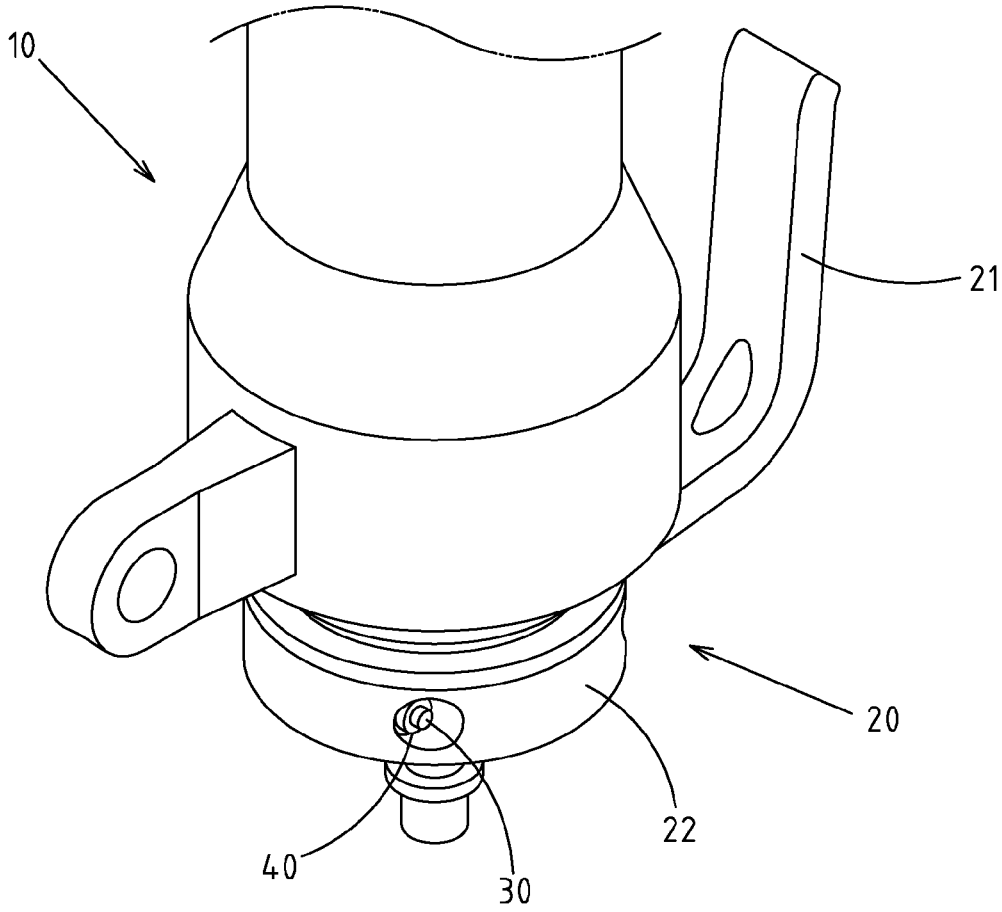
FIG. 1 shows an assembled perspective view of the hook and pneumatic tool of the present invention.
Figure 2:
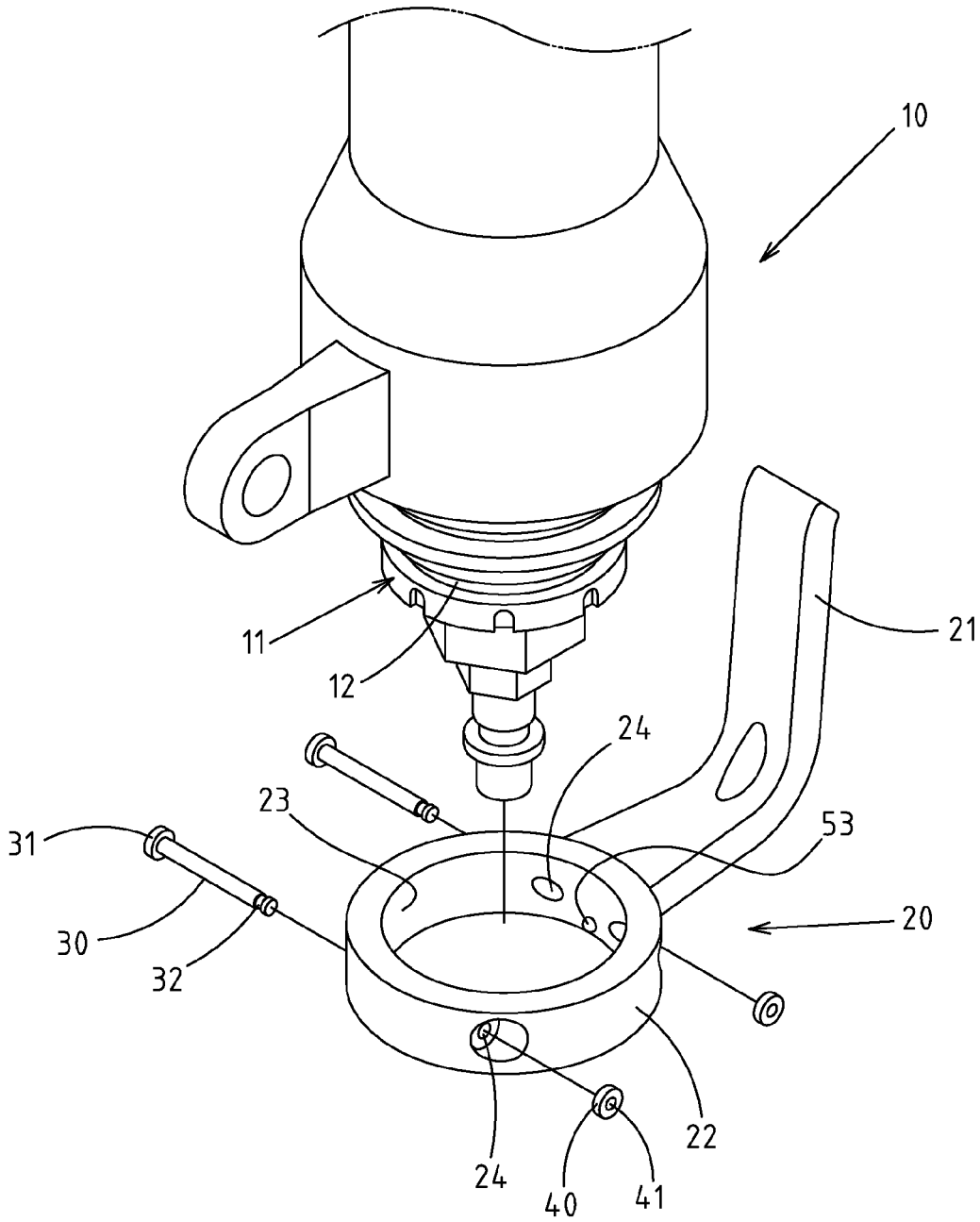
FIG. 2 shows an exploded perspective view of the hook and pneumatic tool of the present invention.

The features and the advantages of the present invention will be more readily understood upon a thoughtful deliberation of the following detailed description of a preferred embodiment of the present invention with reference to the accompanying drawings.

As shown in FIGS. 1–4, there is a limit structure for the hook of a pneumatic tool structure embodied in the present invention.

The invention includes a pneumatic tool body 10, which can be any hand tool that is pneumatic, such as pneumatic handle, pneumatic gun.

A hook assembly part 11 is the cylinder shaped area that is preset on the pneumatic tool body 10.

A ring groove 12 is located on the circumferential area of the hook assembly part 11.

A hook 20 includes a hanger 21 and a loop cover 22; among them, the center of the loop cover 22 has a slip hole 23 that can be pinned from outside the hook assembly part 11.

Two radial through-holes 24 are located at two radial spaced locations on the loop cover 22 of the hook 20, and the center line of these two radial through holes 24 go through the two corresponding sides of the ring groove 12 mentioned above.

Two stick-like through fixers 30 have an expanded end 31 on its first end, and its second end has a limit assembly part 32 for limit part, and this second end pins through the radial through-holes 24 mentioned above and its corresponding ring groove 12. By locking the middle of these two through fixers 30 at the two relative sides of the ring groove 12 separately, the hook 20 reaches the combination of limit state that is rotatable.

Two limit parts 40 are assembled to the limit assembly parts 32 for limit parts mentioned above, and by pinning the through fixers 30 to achieve the positioning, and to prevent them from getting loose.

After the hook of the pneumatic tool disclosed in the present invention is positioned by the through fixers 30 mentioned above, the hook 20 will then be in a 360° rotating condition, and is able to be adjusted to the desired angle according to the user's need.

Among them, the limit assembly parts 32 for limit part on the second end of the through fixers 30 mentioned above are better shaped like a ring groove, so that the limit part 40 mentioned above, which is made of elastic ring cover (can be rubber material), can be positioned by tightly binding the limit assembly part 32 for limit part to the slip hole 41 of the limit part 40. On the other hand, when the user desires to disassemble the through fixer 30, it can be achieved by taking apart the limit part 40 forcefully to disassemble the through fixers 30, which is an advantage of speed disassembly.

Figure 6:
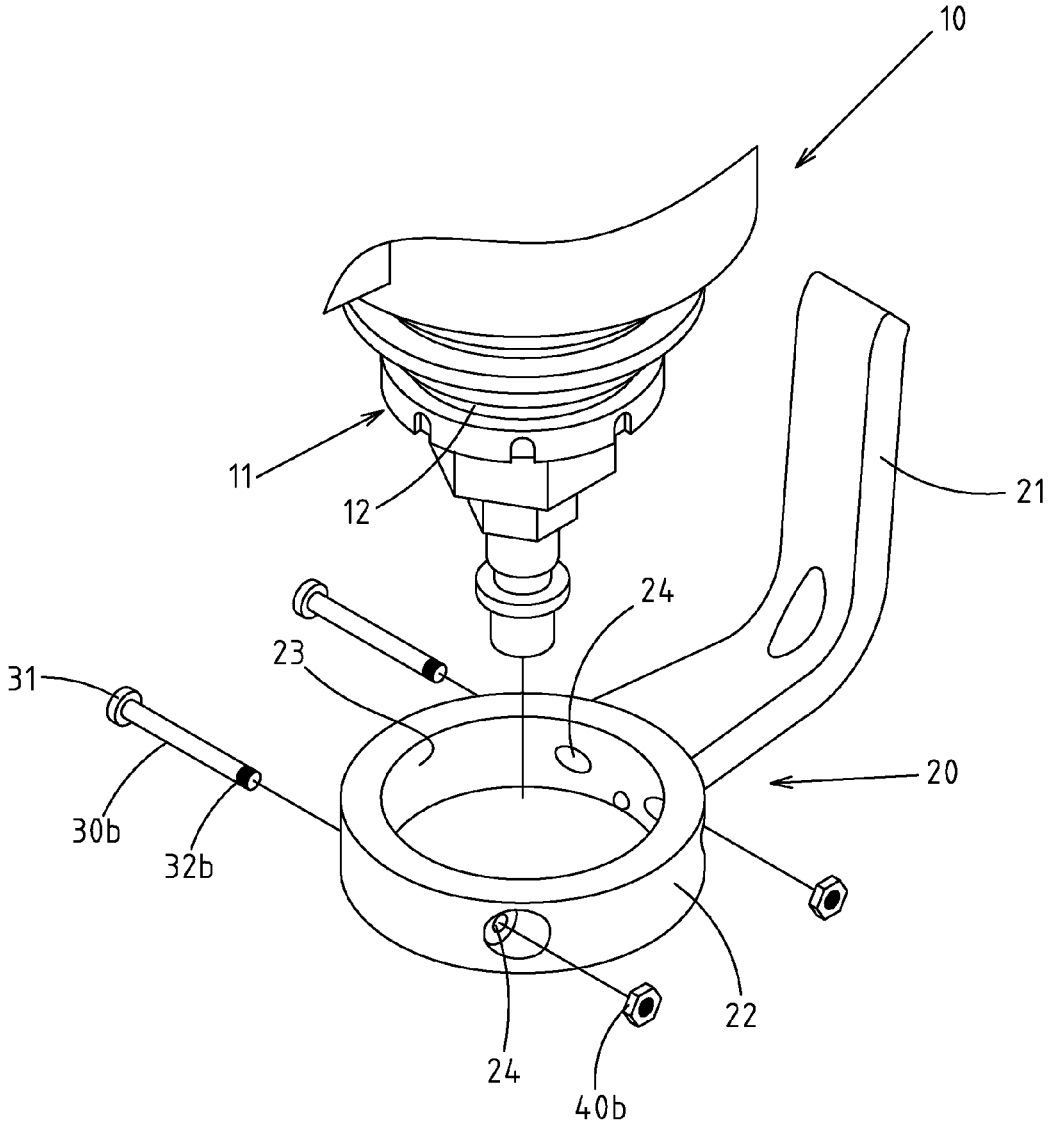
FIG. 6 shows another perspective view of an embodiment of the through fixer of the present invention.

As shown in FIG. 6, which is another embodiment of the through fixer mentioned above, the limit assembly part 32*b* for the limit part on the second end of the through fixer 30*b* shown in the figure is a spiral type end, therefore, the limit part 40*b* is a nut.

Figure 7:
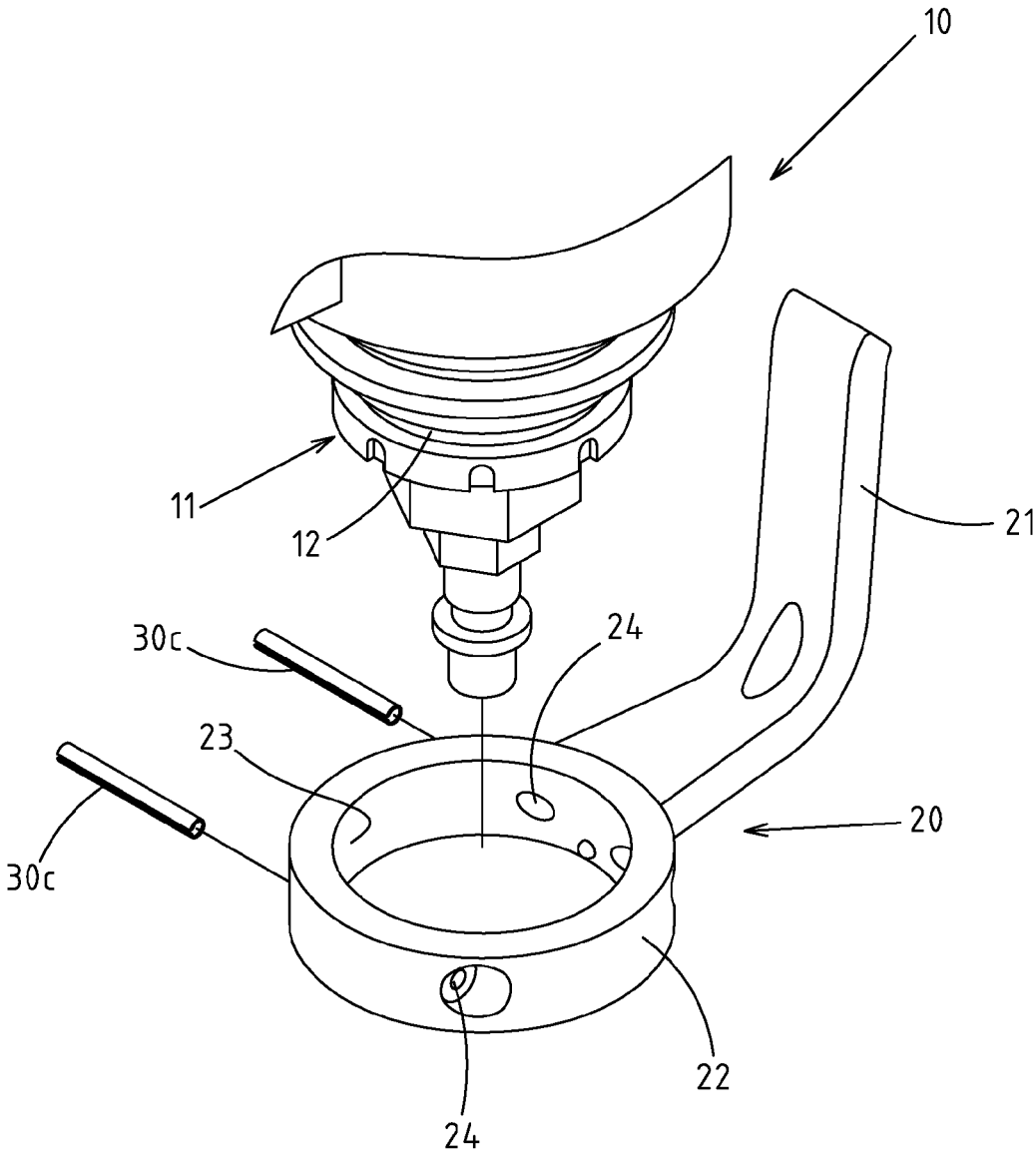
FIG. 7 shows another perspective view of an embodiment of the through fixer of the present invention.

As shown in FIG. 7, which is another embodiment of the through fixer mentioned above, the through fixer 30*c* shown in the figure is a pin, by tightly pinning and securing it to the radial through hole 24 of the loop cover 22 of the hook 20 to achieve the same effect of the limit hook 20.

Figure 3:
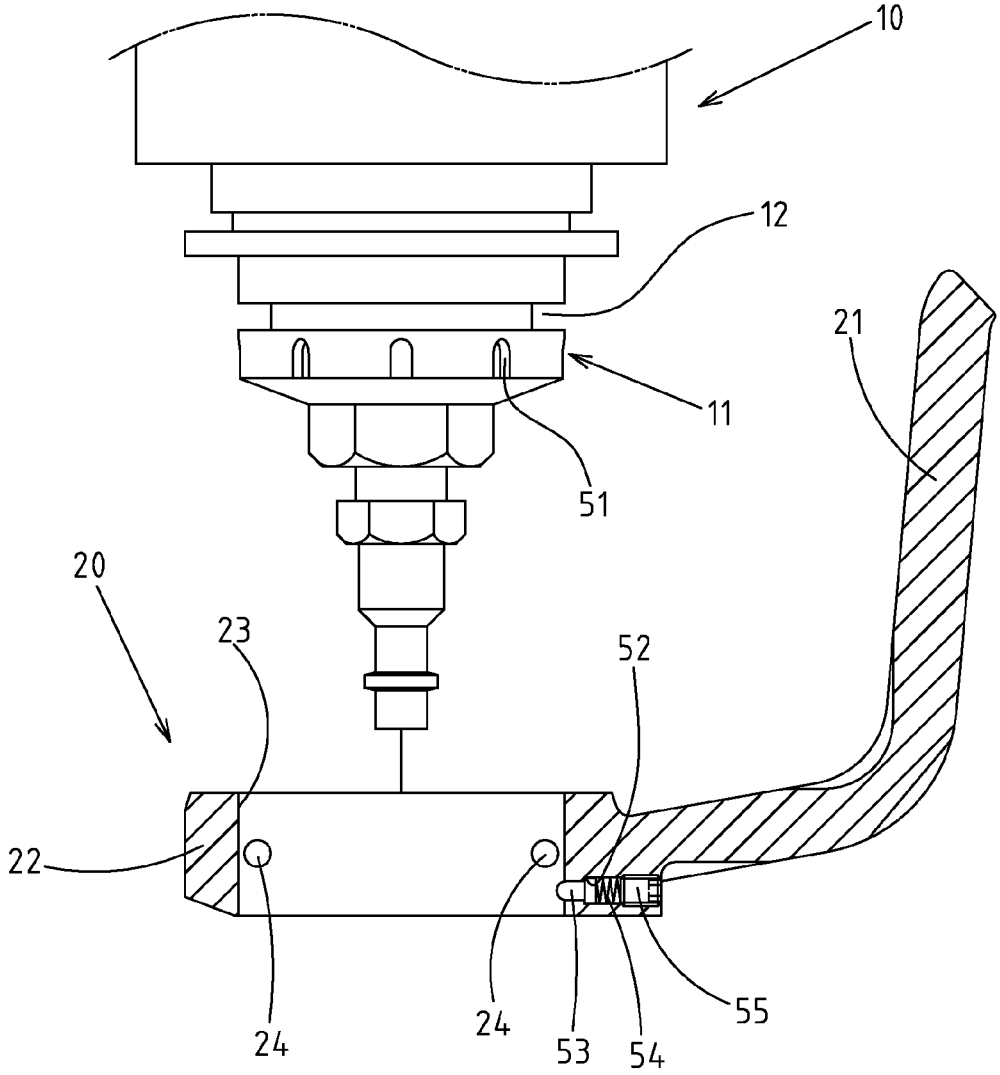
FIG. 3 shows an exploded sectional view of the hook and a partial elevation view of a pneumatic tool of the present invention.
Figure 4:
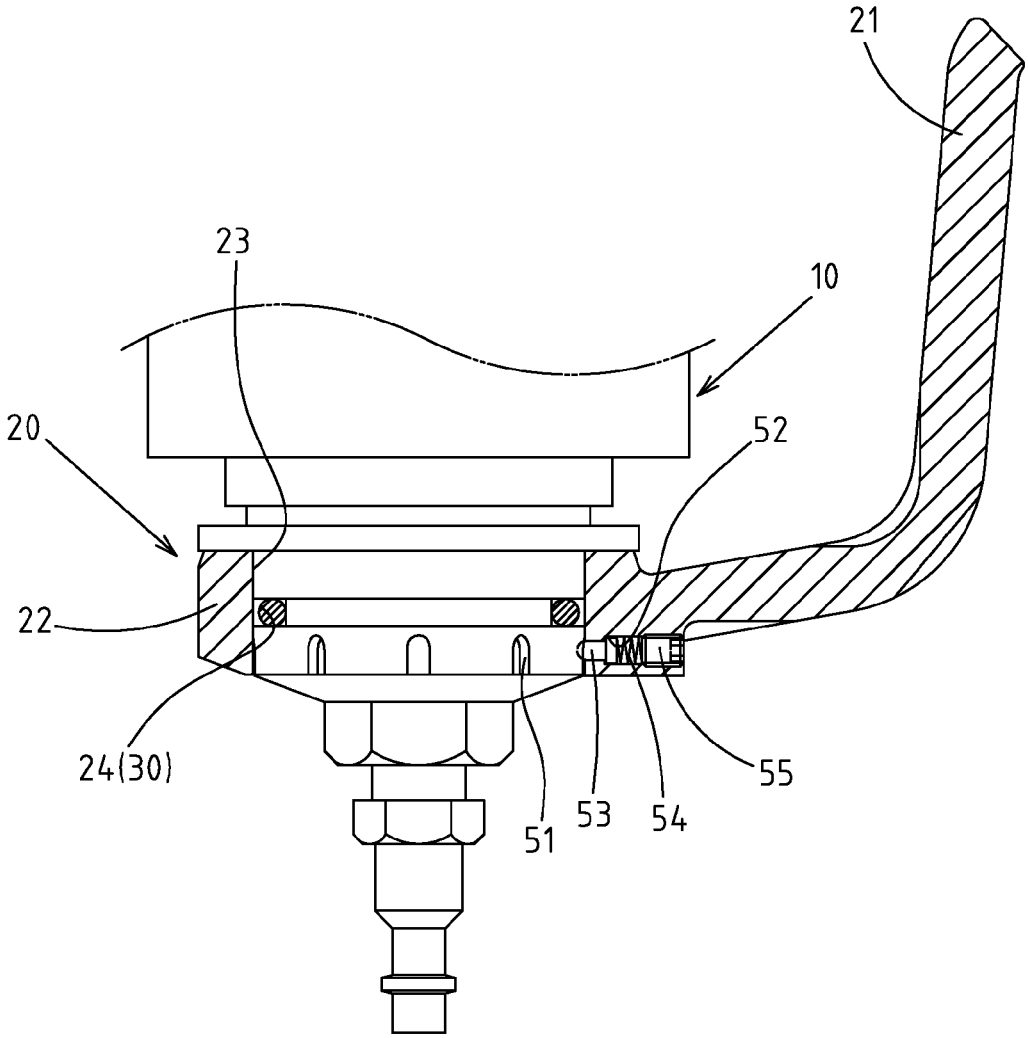
FIG. 4 shows an assembled vertical sectional view of the hook and a partial elevation view pneumatic tool of the present invention.
Figure 5:
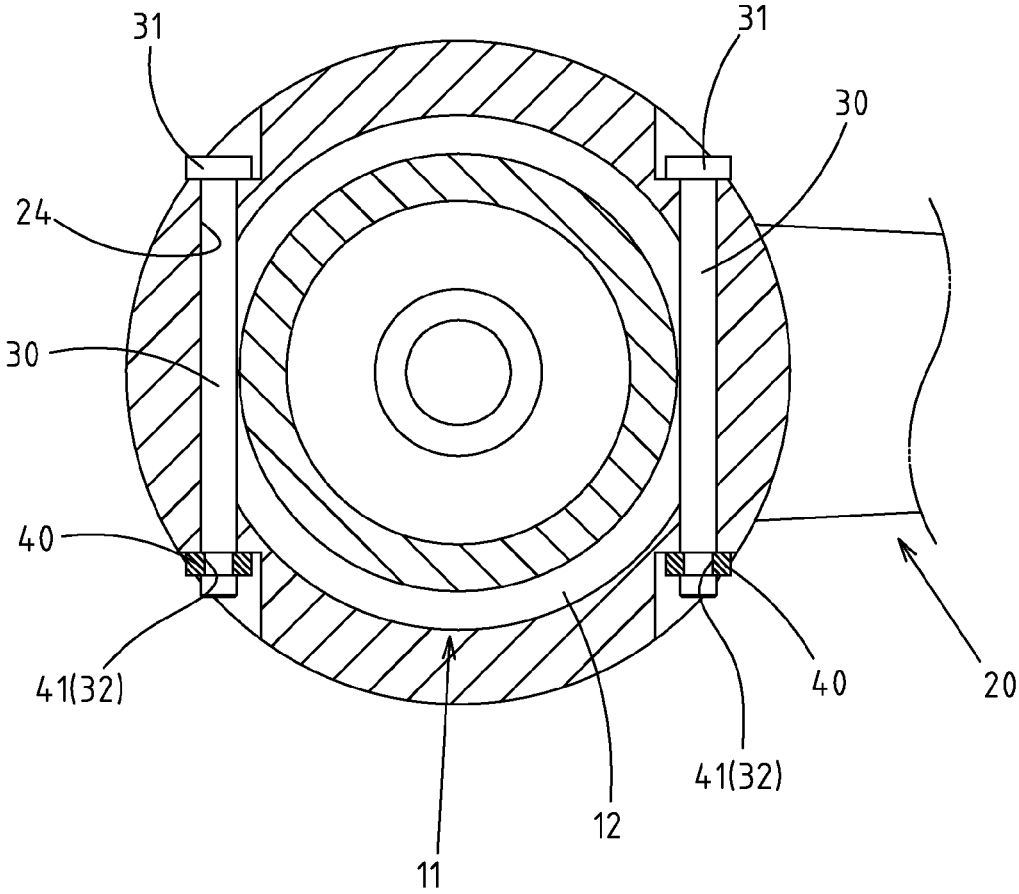
FIG. 5 shows an assembled horizontal sectional view of the hook and pneumatic tool of the present invention.

Among these, the space between the loop cover 22 of the hook 20 and the hook assembly part 11 of the pneumatic tool body 10 can be structured with positioning components, and to make the hook turn to achieved the positioning effect; please see FIG. 3, 4, and the positioning components mentioned above can include the followings:

Several fixing edges 51 are located on the edge of the hook assembly part 11.

A containment hole 52 is located radially on one side of the loop cover 22 of the hook 22.

A fixing axle 53 can be inserted into the inner end of the containment hole 52, and by so doing, the fixing edge 51 mentioned above is locked.

A spring 54 is to support the fixing axle 53.

A limit bolt 55 is to be screwed onto the outer end of the containment hole 52 to position the fixing axle 53 and spring 54.

Figure 8:
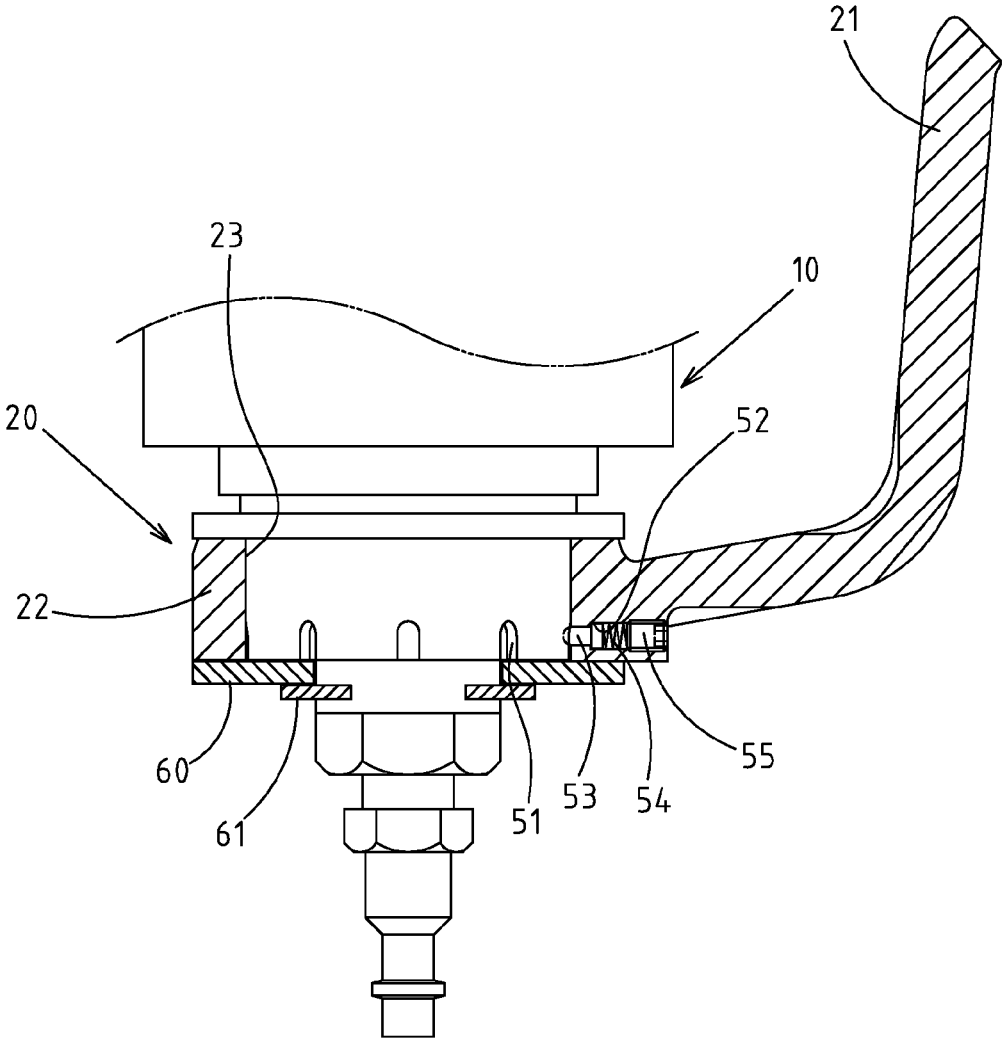
FIG. 8 shows another combined sectional and perspective view of the embodiment of the structure of the present invention.

Among these, as shown in FIG. 8, which is another embodiment of the structure of the present invention. The difference between this structure and the embodiment mentioned above is the hook assembly part 11 of the pneumatic tool body 10 is linked to a supporting ring 60 at the bottom after it is connected to the loop cover 22 of the hook. The supporting ring 60 is limited by connecting to a locking ring 61 at the bottom of the supporting ring, and it indirectly limits this hook 20.

Figure 9:
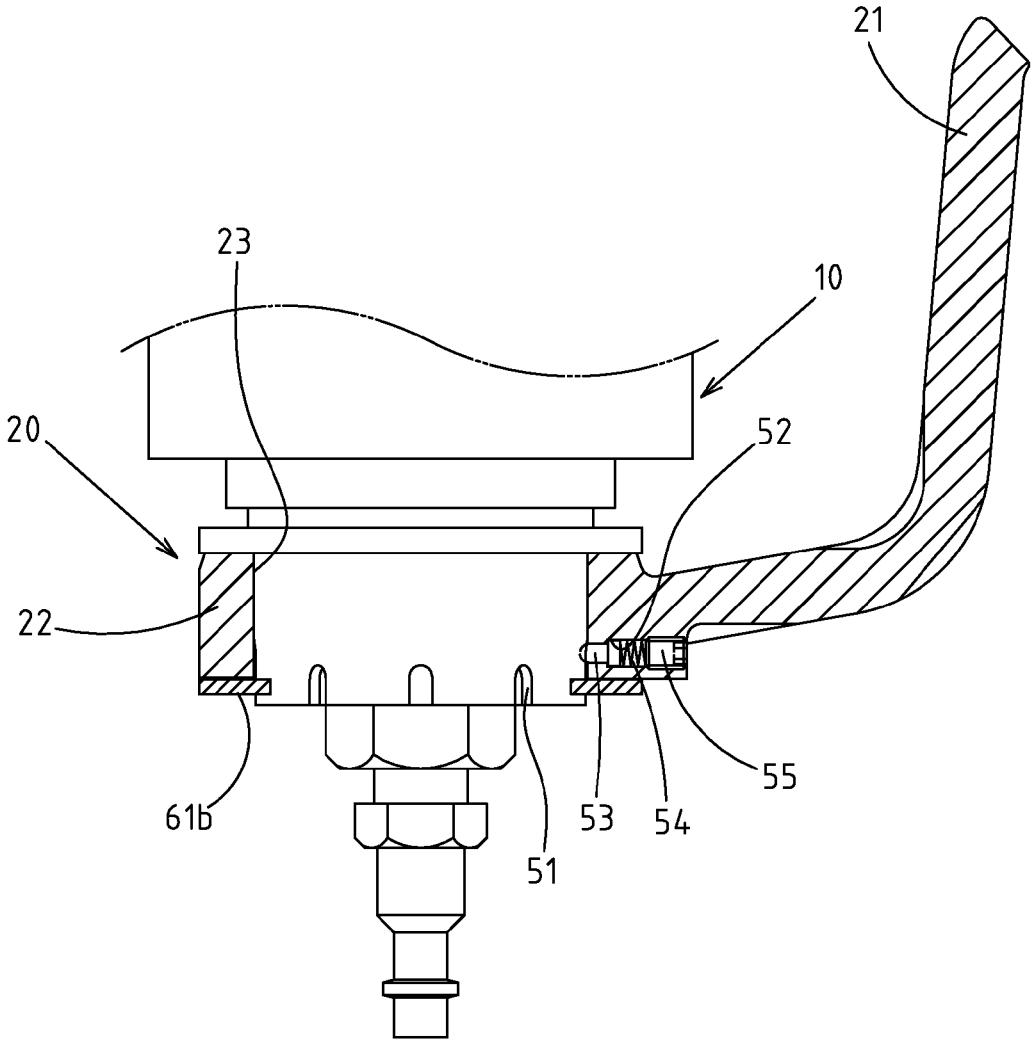
FIG. 9 shows another combined sectional and perspective view of the embodiment of the structure of the present invention.

Among these, as shown in FIG. 9, which is another embodiment of the structure of the present invention, and is the modified embodiment of structure mentioned in the preceding paragraph. Its characteristic is the hook assembly part 11 of the pneumatic tool body 10 is directly connected to a linking ring 61*b* at the bottom after it is connected to the loop cover 22 of the hook, and by so doing to achieve the purpose of limiting the hook 20 directly.

I claim:

1. A hook assembly for supporting a pneumatic tool in which the pneumatic tool has a cylindrically-shaped area with a ring groove formed therein, the hook assembly comprising:

a hanger;

a loop cover connected to an end of said hanger, said loop cover having a slip hole formed on an interior thereof, said slip hole suitable for slidably fitting over the cylindrically-shaped area of the pneumatic tool, said loop cover having at least one radial through hole, the through hole having a centerline extending through a portion of the ring groove when said loop cover is fitted over the cylindrically-shaped area; and a fixer having an elongated shape, said fixer extending through the through hole so as to have a portion extending as a chord across said slip hole such that said portion is suitable for receipt within said ring groove when said loop cover is fitted over the cylindrically-shaped area.

2. The hook assembly of claim 1, said fixer being fixed mounted within the through hole.

3. The hook assembly of claim 1, said fixer being releasably received in the through hole.

4. The hook assembly of claim 3, said fixer having a head at one end thereof, said head having a diameter greater than a diameter of a remainder of said fixer, said fixer having a groove formed at an end thereof opposite said head.

5. The hook assembly of claim 4, further comprising:

an elastic ring cover received in said groove of said fixer, said elastic ring cover having a diameter greater than a diameter of the through hole.

* * * * *